United States Patent [19]

Vogel

[11] Patent Number: 4,817,645

[45] Date of Patent: Apr. 4, 1989

[54] IN-PROCESS WIRE CLEANING

[75] Inventor: Ralph A. Vogel, Three Rivers, Mich.

[73] Assignee: Essex Group, Inc., Fort Wayne, Ind.

[21] Appl. No.: 99,271

[22] Filed: Sep. 21, 1987

[51] Int. Cl.[4] ..... B08B 1/00

[52] U.S. Cl. ..... 134/15; 134/16; 134/122 R; 134/32; 15/210 B

[58] Field of Search ..... 134/14, 15, 16, 122 R, 134/32; 15/210 B

[56] References Cited

U.S. PATENT DOCUMENTS

| | | | |
|---|---|---|---|
| 2,064,650 | 7/1952 | Mottelson | 15/210 B |
| 2,255,154 | 9/1941 | Esposito | 15/210 B |
| 3,527,610 | 9/1970 | Stephenson | 134/15 |

*Primary Examiner*—H. M. S. Sneed
*Assistant Examiner*—Sharon T. Cohen
*Attorney, Agent, or Firm*—Charles E. Sohl

[57] ABSTRACT

Methods for cleaning in-process wire are developed. In one embodiment a moving string loops around the wire and advances to present a clean surface to remove dirt from the surface of the moving wire.

4 Claims, 1 Drawing Sheet

IN-PROCESS WIRE CLEANING

DESCRIPTION

1. Technical Field

This invention relates to wire production and specifically to the cleaning of wire during the production process at a rate commensurate with the production rate.

2. Background Art

Wire of various sorts, especially copper, wire is a widely used industrial commodity produced in great volume. Modern wire production techniques involve melting and casting of the basis metal, including inter alia copper, aluminum, steel and the like, and mechanical working of the cast material to the finished wire size.

The mechanical working process is generally performed by drawing the wire through dies. Such drawing processes may be performed on wire moving at speeds of hundreds or even thousands of feet per minute. When processing wire, especially at high rates of speed, it is important that the wire surface be clean. Dirt buildup on the wire surface can cause breakage, die wear and other defects. Surface contamination can occur when the wire is annealed between drawing operations. It is conventional in drawing to apply a lubricant coating to reduce friction. Such lubricants will decompose to a carbonaceous residue during annealing. Shavings or other metallic particles are often generated during drawing and adhere to the rod surface. Such carbonaceous residue and metallic particles on the wire surface can cause problems in downstream production steps because they can accumulate and eventually cause abrasion or breakage of the wire. It is particularly important to provide a clean wire surface immediately prior to application of enamel.

It is known to use rags, felt strips or pieces of foam plastic which bear against the rod to remove surface contamination. Such cleaning methods are of limited effectiveness because the contamination removed from the wire builds up on the cleaning media and the media soon becomes saturated with contaminants and becomes itself abrasive and likely to damage the wire.

Accordingly, it is the object of the invention to describe a method and apparatus for cleaning the surface of in-process wire in such a way that the removed dirt does not accumulate and the cleaning media always provides a clean surface receptive to removal of dirt and other contamination.

DISCLOSURE OF INVENTION

According to the present invention wire is cleaned on an in-process basis at a rate of wire travel of hundreds or thousands of feet per minute. The wire is cleaned by contact with at least one string. One or more strings are caused to contact the wire so that there is at least 360° contact around the wire circumference with the string. The string(s) are arranged to advance slowly at a rate commensurate with the rate of dirt removed from the wire. Thus, the wire surface is cleaned by mechanical contact with the string, but because of the advancing motion of the string there is always a relatively clean string surface in contact with the wire surface.

The foregoing, and other features and advantages of the present invention will become more apparent from the following description and accompanying drawings.

BEST MODE FOR CARRYING OUT THE INVENTION

Figure 1:
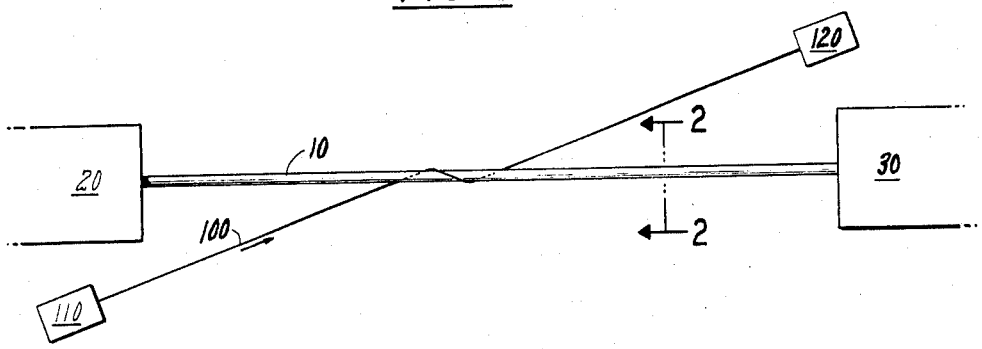
FIG. 1 shows an invention embodiment in which a single string cleans a wire by looping once around the wire.
Figure 2:
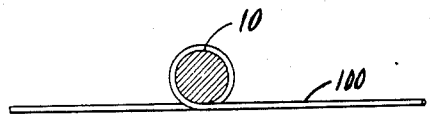
FIG. 2 is a sectional view through the FIG. 1 embodiment.

A basic embodiment of the invention is shown in FIG. 1 where a wire 10 is passing between production operation stations 20 and 30. Production station 20 will typically be a dirt generating operation such as an annealing furnace while production station 30 will be an operation station requiring clean wire, such as a drawing or enameling operation. Cleaning is accomplished by string 100 which is shown approaching the wire at a low angle, typically less than about 20° between wire axis and string axis, then looping or wrapping completely around the wire and leaving the wire at a low angle on the order of 20° or less. The cleaning string passes between payoff means 110 and pickup means 120. FIG. 2 is a sectional view through FIG. 1 showing that the string 100 wraps around 360° or the entire wire circumference.

In practice the string is slowly advanced from the payoff means to the pickup means. The direction of relative motion of the string can be either in the same sense as the motion of the wire or in the opposite sense. The pickup means is preferably arranged to provide a slight string tension in order to assure good contact between the string and the wire surface.

The invention has been described with reference to a string which can be described as a fibrous textile array and which may be woven, wound, twisted or the like and the word string includes thread, cord, twine and rope any of which may be employed in appropriate circumstances and in appropriate sizes. The string can be constructed from materials including cotton and synthetic materials such as rayon or nylon, cotton being preferred as a cheap, soft absorbant material. The string may also be replaced by a strip of woven material such as cloth which may be wound around the wire in the same fashion as the string.

While the wire may be moving at rates of from 100 to 5,000 feet per minute the string need advance only at a much slower rate, a rate which is largely determined by the amount of dirt which the string is picking up from the wire. Thus, if the wire is clean the string can advance at a slower rate than if the wire is dirty.

Figure 3:
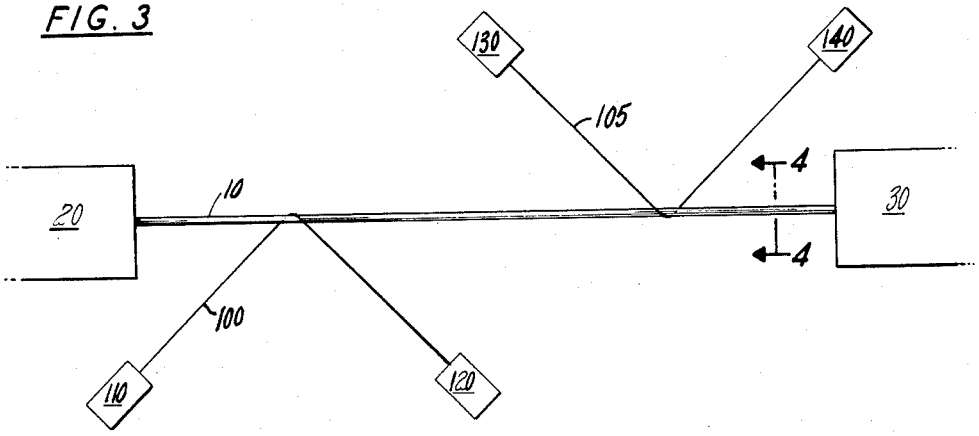
FIG. 3 shows an embodiment including two strings.
Figure 4:
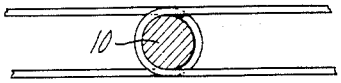
FIG. 4 is a sectional view through the FIG. 3 embodiment.

It is suggested that when the wire moves at 100 feet per minute that the string might move at the rate 1 inch to 20 inches per hour while if the wire is moving at 1,000 feet per minute the string might advance at the rate of 10 inches to 1000 inches per hour. FIG. 1 illustrates a straight forward embodiment of the invention concept in which a single string cleans the entire circumference of the wire. A single string can, of course, be wrapped more than once about the wire. Of course, other variations are possible such as that shown in FIG. 2 wherein two strings are shown each of which clean approximately 80 circumference of the copper wire. Further variants are possible such as using more strings each of which covers a correspondingly smaller angular portion of the wire surface and using multiple sequential strings wherein a first string removes the bulk of the dirt and a second downstream string performs a final cleaning operation. FIG. 3 shows an embodiment which utilizes two strings 100 and 105 which each contact 180° of the wire circumference. Payoff means 110 and 130 cooperate with pickup means 120 and 140 to pass the strings about the wire at the desired rate. FIG. 4 is a sectional view through the wire string cleaned.

It is also within the scope of the invention to provide means for applying a cleaning material to the string or providing a string which has such material on its surface to enhance cleaning. An aqueous soap solution can be used where surface dirt is the primary problem. An organic solvent can be used where lubricant removal is desired. A mild acid solution can be used if oxide removal is required.

Although this invention has been shown and described with respect to detailed embodiments thereof, it will be understood by those skilled in the art that various changes in form and detail thereof may be made without departing from the spirit and scope of the claimed invention.

I claim:

1. A method for cleaning a moving wire with a moving cleaning surface which comprises:

wrapping at least one string about the wire so that the at least one string contacts the wire at least around the entire wire circumference, with the string approaching and departing from the wire at a low angle, and translating the string between a payoff and pickup means so that a clean moving string surface contacts the moving wire surface.

2. A method as in claim 1 in which more than one string is employed.

3. A method as in claim 1 wherein said at least one string is moistened with a cleaning agent prior to contacting the wire.

4. An apparatus for cleaning a moving wire which comprises:

at least one string payoff and at least one string pickup means, for controllably moving at least one string between said at least one payoff and said at least one pickup means, said at least one string approaching the moving wire to be cleaned at a low angle, wrapping about the wire over at least the entire wire circumference and leaving the moving wire at a low angle said moving string presenting a new clean surface to said move wire.

* * * * *